US009358609B2

(12) United States Patent
Dallinger et al.

(10) Patent No.: US 9,358,609 B2
(45) Date of Patent: Jun. 7, 2016

(54) PROCESS FOR PRODUCING A TURBINE HOUSING AND TURBINE HOUSING

(71) Applicant: Siemens Aktiengesellschaft, München (DE)

(72) Inventors: Heinz Dallinger, Mülheim an der Ruhr (DE); Kai Wieghardt, Bochum (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 128 days.

(21) Appl. No.: 14/083,866

(22) Filed: Nov. 19, 2013

(65) Prior Publication Data

US 2014/0076466 A1 Mar. 20, 2014

Related U.S. Application Data

(62) Division of application No. 12/671,069, filed as application No. PCT/EP2008/059813 on Jul. 25, 2008, now abandoned.

(30) Foreign Application Priority Data

Aug. 8, 2007 (EP) ..... 07015627

(51) Int. Cl.
*B22D 19/04* (2006.01)
*B22D 19/16* (2006.01)
*B22D 25/00* (2006.01)
*F01D 25/26* (2006.01)

(52) U.S. Cl.
CPC ..... *B22D 25/00* (2013.01); *F01D 25/26* (2013.01); *F05D 2230/21* (2013.01); *F05D 2230/30* (2013.01); *F05D 2230/31* (2013.01); *F05D 2230/40* (2013.01); *F05D 2240/14* (2013.01); *F05D 2260/94* (2013.01); *F05D 2260/941* (2013.01); *F05D 2300/502* (2013.01); *Y10T 29/4998* (2015.01)

(58) Field of Classification Search
CPC ..... B22D 19/00; B22D 19/04; B22D 19/16
USPC ..... 164/94, 95, 111; 29/527.5
See application file for complete search history.

(56) References Cited

U.S. PATENT DOCUMENTS 4,023,613 A * 5/1977 Uebayasi et al. .. B22D 19/0018 164/100
7,066,235 B2 * 6/2006 Huang ..... B22D 19/0027 164/111

* cited by examiner

*Primary Examiner* — Kevin P Kerns

(57) ABSTRACT

A method is provided of producing a housing with two layers. The method includes casting an inner casting formed as an inner layer, and then casting an outer casting. The inner casting is used as a wall and the outer casting is formed as an outer layer. The inner layer is made of a more heat resistant material than the outer layer. Hooked formations are fitted on the inner casting in order to improve an integral bonding to the outer layer.

18 Claims, 1 Drawing Sheet

PROCESS FOR PRODUCING A TURBINE HOUSING AND TURBINE HOUSING

This application is a divisional application of U.S. patent application Ser. No. 12/671,069 filed on Jan. 28, 2010, now abandoned which is the U.S. National Stage of International Application No. PCT/EP2008/059813 filed Jul. 25, 2008, and claims the benefit thereof. The International Application claims the benefits of European Application No. 07015627.8 EP filed Aug. 8, 2007. All of the applications are incorporated by reference herein in their entirety.

FIELD OF INVENTION

The invention relates to a housing for a thermal turbomachine and particularly to a process for producing a housing designed with at least two layers for a turbomachine.

BACKGROUND OF INVENTION

Pluralities of measures are possible in order to achieve high degrees of thermal efficiency. One of the measures would be to increase the inflow temperatures of the steam flowing into the thermal turbomachine, in particular a steam turbine. At present, efforts are being made to increase the steam inflow temperature to up to 700° C. or even higher.

Such high steam inflow temperatures require a specific selection of materials which withstand the thermal loading. According to current findings, nickel-based materials are suitable for high steam inflow temperatures. However, this material is many times more expensive than customary materials.

In thermal turbomachines, for example steam turbines, the rotor and the housing, in particular the inner housing, are subjected to thermal loading. The housings of steam turbines are usually designed with two shells. In this case, the inner housing contains the portion of steam expansion, where the highest thermal loading occurs, and comparatively cooler steam, e.g. the waste steam, flows around this inner housing and is absorbed again by the outer housing. The outer housing is arranged around the inner housing.

The inner housings are designed as cast structures, i.e. they are as it were produced from a casting, even though only the one flow region has to withstand the high thermal loading. A material which withstands the thermal loading and is then used for the entire inner housing is often selected. However, this is not optimal in terms of cost since comparatively highly heat resistant materials are used for regions which are subjected to less thermal loading and where comparatively low temperatures prevail. Comparatively inexpensive materials which are not so highly heat resistant can be used at these locations.

The manufacturing limits for nickel-based materials mean that the weight of the inner housing is problematic for future steam turbines which are to be suitable for steam inflow temperatures of 700° C., since it may prove to be that housings such as these can no longer be cast owing to their weight.

A further problem with inner housings such as these is warping, which occurs during opening after a specific operating period, e.g. during a major overhaul. This warping occurs as a result of high temperature differences over the wall thickness owing to the intended cooling effect. Such distortion can be observed, in particular, in the inflow region of the inner housing. The distortion results in thermal stresses.

EP 1 033 478 discloses a housing which is formed from various materials which are axially welded to one another.

It is known from EP 1 586 394 to form regions of components which are resistant to loading with an additional material in order to increase the resistance.

SUMMARY OF INVENTION

It would be desirable to provide an inner housing which is inexpensive to produce and withstands the thermal loading.

This is where the invention becomes relevant. An object of the invention is to specify an inner housing which is suitable for high thermal loading and is also inexpensive to produce.

The object is achieved by a housing for a thermal turbomachine, wherein the housing is designed with at least two layers, at least an inner layer and an outer layer, wherein the inner layer is made from a more heat resistant material than the outer layer.

A further object of the invention is to specify a process for producing the housing designed with two layers.

This object is achieved by a production process comprising the following steps:

casting an inner casting formed as the inner layer, casting an outer casting, wherein the inner casting is used as a wall and the outer casting is formed as the outer layer.

Advantageous developments are specified in the dependent claims. The invention adopts the new approach of forming only partial regions of the housing from a material which withstands the thermal loading. Other regions of the housing may be produced from other, less expensive materials. According to the invention, the housing is designed with two layers, wherein the inner layer is subjected to high thermal loading during operation and therefore has to be formed from a more heat resistant material than the outer layer. Therefore, instead of forming the entire housing from the highly heat resistant material, it suffices to form only part of the housing from the highly heat resistant material.

The inner layer is advantageously formed from a nickel-based material. Nickel-based materials in particular are suitable for thermal loading. In particular, it is conceivable that in future 700° C. steam turbines may be produced from this material.

In a further advantageous development, the inner layer is formed from alloy 625. This material has proven to be suitable in tests which have shown that this material is inexpensive to produce and also withstands thermal loading.

A 10% by weight chromium steel, which is less expensive but less heat resistant than the nickel-based material, is advantageously used for the outer layer.

The outer layer may be, in particular, the material GX12CrMoVNbN9-1. It has also been shown that this material is suitable for use as the outer layer since it is inexpensive.

According to the invention, it is advantageously possible to select, as it were as a material pair, firstly a 9-10% by weight chromium steel, in particular GX12CrMoVNbN9-1, for the inner layer and to use a 1-2% by weight chromium steel, such as e.g. G17CrMoV5-10, for the outer layer.

This provides a material combination which is less expensive than nickel-based materials but is nevertheless suitable for inner housings in steam turbines subjected to thermal loading.

According to the invention, the inner layer is integrally bonded to the outer layer.

According to the invention, the solution directed to the process is developed in that the inner and outer castings are subjected to heat treatment during solidification. As an alternative, the inner and outer castings may also be subjected to heat treatment after solidification. The heat treatment is then carried out in one step at the lower tempering temperature of the two materials of the inner and outer castings and for a duration of 8-12 hours.

Hooked formations are advantageously arranged on the inner casting in order to improve the integral bonding. This makes it possible for the outer casting, which uses the inner casting as a wall, to be bonded to the inner casting in a mechanically improved manner.

According to the invention, an inner housing is produced from the materials listed further above, wherein the inner layer is deposition-welded to the outer layer. The housing may advantageously be subjected to heat treatment after the deposition welding.

BRIEF DESCRIPTION OF THE DRAWINGS

An exemplary embodiment of the invention will be explained in more detail below with reference to figures.

DETAILED DESCRIPTION OF INVENTION

Figure 1:
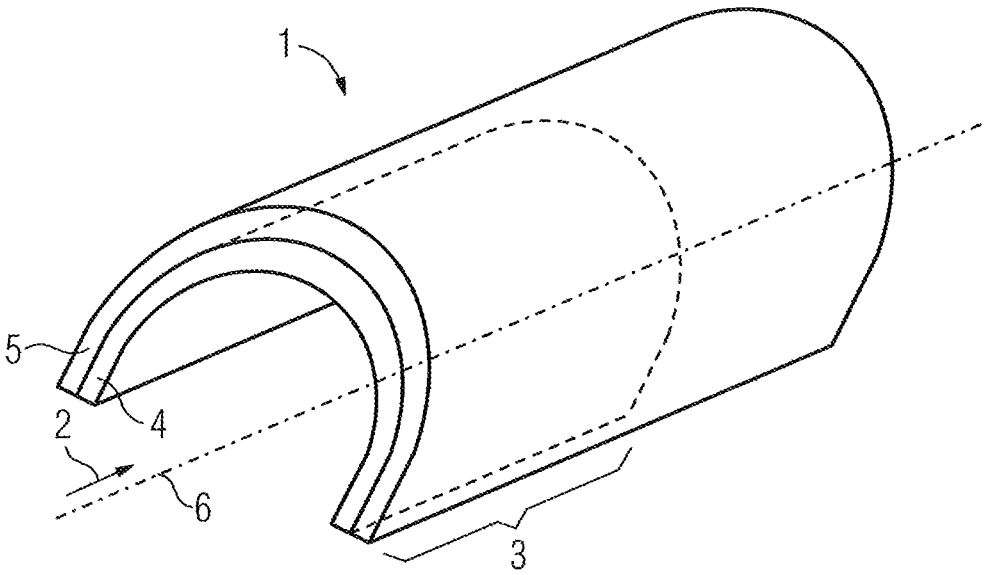
FIG. 1 is a perspective illustration of the upper half of a housing for a turbomachine.

FIG. 1 shows the upper half of a housing 1 of a thermal turbomachine. By way of example, the thermal turbomachine may be a steam turbine. By way of example, the housing 1 may be an inner housing of a steam turbine. During operation, steam flows in a flow direction 2 between a rotor (not shown in more detail) and the inner housing. In high-pressure steam turbines, the steam may assume values of above 600° C. and above 300 bar. The steam cools down and loses pressure in the flow direction 2. This means that high thermal loading prevails in the front region 3 of the inner housing.

In order to withstand the thermal loading, the housing 1 has at least two layers 4, 5. The exemplary embodiment shown in FIG. 1 comprises an inner layer 4 and an outer layer 5, which is arranged around the inner layer 4. The inner layer 4 is formed from a more heat resistant material than the outer layer 5.

The inner layer 4 is formed from a nickel-based material. The outer layer 5 is arranged around the inner layer 4. The housing 1 is substantially arranged around the axis of rotation 6, wherein the outer layer 5 is arranged around the inner layer 4 with respect to said axis of rotation 6.

In an alternative embodiment, the inner layer 4 may be formed from the material alloy 625 or from a 10% by weight chromium steel. In an alternative embodiment, the outer layer 5 may be formed from the material GX12CrMoVNbN9-1. This provides a material pair which is suitable for particular thermal loading.

A different material pair is recommendable for different thermal loading, for example slightly lesser thermal loading. In this case, the inner layer 4 would be formed from a 9-10% by weight chromium steel and the outer layer 5 would be formed from a 1-2% by weight chromium steel. Materials which can be selected here are the material GX12CrMoVNbN9-1 for the inner layer 4 and the material G17CrMoV5-10 for the outer layer 5. The inner layer 4 is integrally bonded to the outer layer 5.

The first step when producing the housing 1 is to cast an inner casting which is formed as the inner layer 4. The next process step involves casting the outer casting, wherein the inner casting is used as a wall and the outer casting is formed as the outer layer 5.

After casting, the inner and outer castings are subjected to heat treatment during solidification. The heat treatment may also take place after solidification. The heat treatment is carried out in one step at a tempering temperature which corresponds to the lower tempering temperature of the materials of the inner and outer castings. In addition, the heat treatment is carried out at the abovementioned tempering temperature for a duration of 8-12 hours.

A hooked formation 10 may be fitted on the inner casting 4(see FIGS. 2 and 3) in order to improve the integral bonding. As a result, the outer casting 5 can be arranged on the inner layer 4 in an improved manner.

Figure 2:
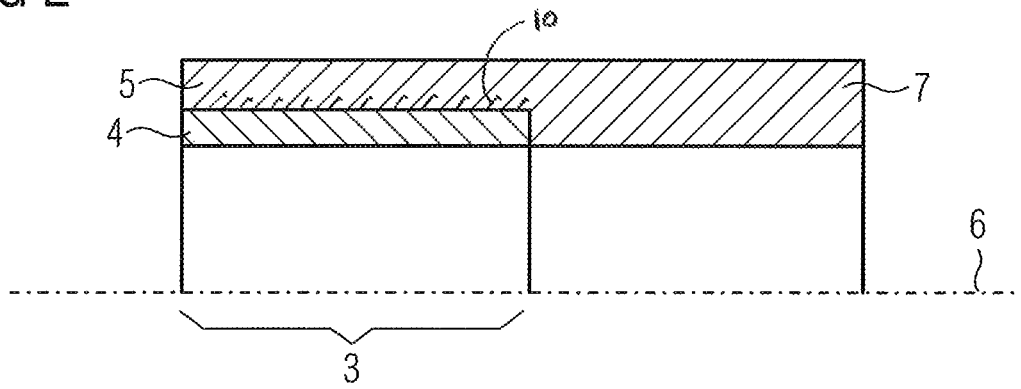
FIG. 2 is a sectional illustration through the housing shown in FIG. 1 in a side view.

FIG. 2 shows a sectional illustration of the housing 1 shown in FIG. 1. Here, the inner layer 4 is limited merely to the front region 3 and, as described further above, is attached to the outer layer 5. In a rear region 7, which is remote from the front region 3, it is possible to dispense with a two-layered design of the housing 1 if the thermal loading is relatively low. The housing 1 may have a multi-layered design, with the individual materials to be selected being adapted to the thermal loading.

Figure 3:
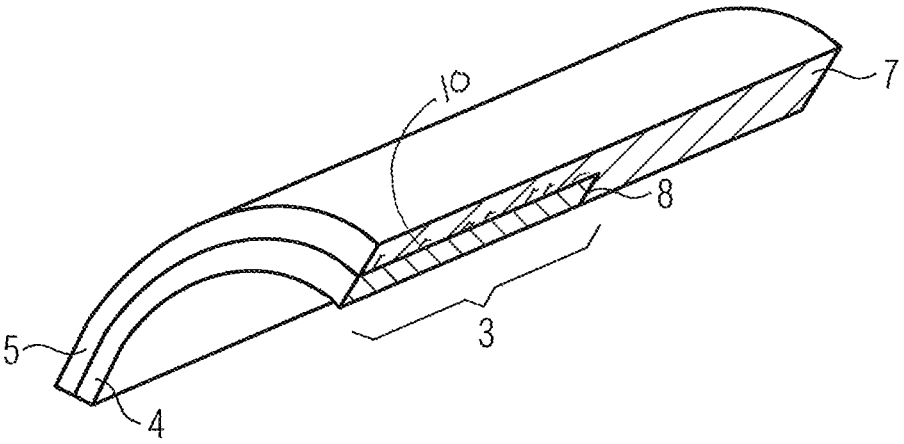
FIG. 3 is a perspective illustration of the housing illustrated in section in FIG. 2.

FIG. 3 shows a perspective view of the housing illustrated in section in FIG. 2.

In order to avoid notches, the thickness of the inner layer 4 can be varied at the contact locations 8 so that no cracks arise in the outer layer 5. In addition, the thickness of the inner layer 4 can be varied in order to counteract the thermal loading which may differ locally.

It is expedient to additionally provide the housing illustrated in FIGS. 1-3 with thermal barrier coatings in order to reduce the thermal loading.

The invention claimed is:

1. A method of producing a steam turbine housing with two layers, comprising:

casting an inner casting formed as an inner layer;

casting an outer casting, wherein the inner casting is used as a wall and the outer casting is formed as an outer layer, wherein the inner layer is made of a more heat resistant material than the outer layer, wherein hooked formations are fitted on the inner casting in order to improve an integral bonding to the outer layer, wherein the steam turbine housing comprises a front region and a rear region with respect to a flow direction, and wherein the inner casting and the outer casting are provided at the front region, and only a single layer of the outer casting is provided in the rear region.

2. The method as claimed in claim 1, wherein the inner and outer castings are subjected to heat treatment during solidification, wherein the heat treatment is carried out in one step at the lower tempering temperature of the materials of the inner and outer castings and for a duration of 8-12 hours.

3. The method as claimed in claim 1, wherein the inner and outer castings are subjected to heat treatment after solidification, wherein the heat treatment is carried out in one step at the lower tempering temperature of the materials of the inner and outer castings and for a duration of 8-12 hours.

4. The method as claimed in claim 1, wherein the inner layer is deposition welded to the outer layer.

5. The method as claimed in claim 4, wherein the housing is subjected to heat treatment after the deposition welding.

6. The method as claimed in claim 1, wherein the inner layer is formed from a nickel-based material.

7. The method as claimed in claim 6, wherein the inner layer is formed from alloy 625.

8. The method as claimed in claim 6, wherein the inner layer is integrally bonded to the outer layer.

9. The method as claimed in claim 1, wherein the outer layer is formed from a 10% by weight chromium steel.

10. The method as claimed in claim 9, wherein the outer layer is formed from the material GX12CrMoVNbN9-1.

11. The method as claimed in claim 1, wherein the inner layer is formed from a 9-10% by weight chromium steel.

12. The method as claimed in claim 11, wherein the inner layer is formed from the material GX12CrMoVNbN9-1.

13. The method as claimed in claim 12, wherein the outer layer is formed from a 1-2% by weight chromium steel.

14. The method as claimed in claim 13, wherein the outer layer is formed from the material G17CrMoV5-10.

15. The method as claimed in claim 11, wherein the outer layer is formed from a 1-2% by weight chromium steel.

16. The method as claimed in claim 15, wherein the outer layer is formed from the material G17CrMoV5-10.

17. The method as claimed in claim 1, wherein the inner layer is integrally bonded to the outer layer.

18. The method as claimed in claim 1, wherein the inner layer has a varying thickness as a function of local thermal loading.

* * * * *